US007305973B2

(12) United States Patent
Okazono et al.

(10) Patent No.: US 7,305,973 B2
(45) Date of Patent: Dec. 11, 2007

(54) FUEL FEED APPARATUS HAVING SUB-TANK AND SUPPORTING MEMBER

(75) Inventors: Tetsuro Okazono, Okazaki (JP); Norihiro Hayashi, Kakamigahara (JP)

(73) Assignee: Denso Corporation (JP)

( * ) Notice: Subject to any disclaimer, the term of this patent is extended or adjusted under 35 U.S.C. 154(b) by 73 days.

(21) Appl. No.: 11/034,047

(22) Filed: Jan. 13, 2005

(65) Prior Publication Data

US 2005/0155584 A1 Jul. 21, 2005

(30) Foreign Application Priority Data

Jan. 19, 2004 (JP) ..... 2004-010680

(51) Int. Cl.
*F02M 37/04* (2006.01)
*F02M 1/00* (2006.01)

(52) U.S. Cl. ..... 123/509

(58) Field of Classification Search ..... 123/509, 123/510, 497, 514, 516; 137/510, 514, 509, 137/572, 574, 576; 417/360, 423.3
See application file for complete search history.

(56) References Cited

U.S. PATENT DOCUMENTS

| | | | | |
|---|---|---|---|---|
| 4,945,884 | A | 8/1990 | Coha et al. | |
| 5,769,061 | A | 6/1998 | Nagata et al. | |
| 5,782,223 | A * | 7/1998 | Yamashita et al. | 123/510 |
| 6,241,883 | B1 * | 6/2001 | Noda | 210/172 |
| 7,066,017 | B2 * | 6/2006 | Kano et al. | 73/118.1 |
| 2002/0000220 | A1 | 1/2002 | Hazama | |
| 2004/0037714 | A1 * | 2/2004 | Koba et al. | 417/360 |

* cited by examiner

*Primary Examiner*—John T. Kwon
(74) *Attorney, Agent, or Firm*—Nixon & Vanderhye PC

(57) ABSTRACT

A fuel feed apparatus includes a lid member, a sub-tank, first and second supporting members, a biasing structure, a supporting portion, and a guide portion. The first and second supporting members are arranged in substantially radially end portions of the cylindrical portion to be substantially radially opposed to each other. The lid member is capable of axially moving relative to the sub-tank via the first and second supporting members. The biasing structure is arranged on the outer periphery of the first supporting member, and is received in the guide portion to bias the lid member and the sub-tank to be apart from each other. The first supporting member defines a groove portion that circumferentially divides an inner wall thereof into at least two planes. The first supporting member is capable of axially reciprocating through the supporting portion.

7 Claims, 6 Drawing Sheets

FUEL FEED APPARATUS HAVING SUB-TANK AND SUPPORTING MEMBER

CROSS REFERENCE TO RELATED APPLICATIONS

This application is based on and incorporates herein by reference Japanese Patent Application No. 2004-10680 filed on Jan. 19, 2004.

FIELD OF THE INVENTION

The present invention relates to a fuel feed apparatus that feeds fuel received in a fuel tank to the outside of the fuel tank.

BACKGROUND OF THE INVENTION

A fuel feed apparatus disclosed in JP-A-9-268957 is capable of stably feeding fuel from an inside of a fuel tank to the outside, even when an amount of fuel received in the fuel tank decreases. The fuel feed apparatus includes a sub-tank receiving a fuel pump and the like. The sub-tank is supported by a supporting member such that the sub-tank is axially displaceable relevant to a lid member that is provided to an opening formed in the fuel tank.

A biasing means such as a spring is provided between the sub-tank and the lid member such that the spring urges the sub-tank and the lid member in the direction, in which the sub-tank and the lid member are apart from each other. Therefore, the sub-tank can be pressed onto the inner bottom plane of the fuel tank, regardless of the inner volume of the fuel tank. As a result, fuel remaining around the sub-tank can be stably drawn into the sub-tank, even when liquid level of fuel decreases in the fuel tank.

A conventional fuel feed apparatus has supporting members such as metallic pipes that are arranged on both radially outer portions of the sub-tank. The biasing means is provided to the outer circumferential side of each of the supporting members arranged on both the radially outer portions of the sub-tank. Alternatively, the biasing means may be provided to the outer circumferential side of one of the supporting members, so that the number of components can be reduced. However, when the biasing means is provided to one of the supporting members, resilient force applied to both the lid member and the sub-tank becomes unstable. That is, the lid member and the sub-tank lose balance therebetween due to difference of resilient force applied by the biasing means. Accordingly, it is difficult to assemble the lid member to the sub-tank on the side of the supporting member, to which the biasing means is provided, due to instability of resilient force applied by the biasing means.

Besides, when the biasing means is provided to only one of the supporting members, the sub-tank may be inclined due to instability of resilient force. As a result, the supporting member, on which the biasing means is not provided, may be inclined. In this situation, the supporting member, on which the biasing means is not provided, slides against a supporting portion, which slidably supports the supporting member, in an inappropriate angle. Accordingly the supporting member does not smoothly slide with respect to the supporting portion, and the supporting member and the supporting portion are abraded with each other. Besides, the sub-tank may not be pressed onto the inner bottom plane of the fuel tank, and fuel may not be properly pumped into the sub-tank.

SUMMARY OF THE INVENTION

In view of the foregoing problems, it is an object of the present invention to produce a fuel feed apparatus that can be easily assembled even when a biasing means is provided to one of supporting members. It is another object of the present invention to produce a fuel feed apparatus, in which a lid member and a sub-tank are capable of smoothly displacing relative to each other even when a biasing means is provided to one of supporting members.

According to the present invention, a fuel feed apparatus is at least partially received in a fuel tank. The fuel feed apparatus includes a lid member, a sub-tank, a first supporting member, a second supporting member, a biasing means, a first supporting portion, and a guide portion. The lid member covers an opening portion formed in the fuel tank. The sub-tank is received in the fuel tank. The sub-tank includes a cylindrical portion and a bottom portion. The bottom portion is located on the opposite side as the lid member with respect to the cylindrical portion. The sub-tank receives a fuel pump. The first supporting member is arranged in a substantially end portion of the cylindrical portion in the radial direction of the cylindrical portion. The first supporting member supports the lid member and the sub-tank such that the lid member is capable of moving relative to the sub-tank in a substantially axial direction of the sub-tank.

The second supporting member is arranged in a substantially end portion of the cylindrical portion in the radial direction of the cylindrical portion. The second supporting member is arranged on a substantially opposite side as the first supporting member in the radial direction of the cylindrical portion. The second supporting member supports the lid member and the sub-tank such that the lid member is capable of moving relative to the sub-tank in the substantially axial direction of the sub-tank. The biasing means is arranged on the outer peripheral side of the first supporting member. The biasing means biases the lid member and the sub-tank to be apart from each other. The first supporting portion is provided to the cylindrical portion of the sub-tank. The first supporting portion slidably supports the first supporting member such that the first supporting member is capable of reciprocating through the first supporting portion in the substantially axial direction of the sub-tank. The guide portion is provided to the first supporting portion. The guide portion is arranged on the side of the lid member with respect to the first supporting portion. The guide portion at least partially surrounds the outer peripheral side of the first supporting member.

The first supporting portion is integrally formed with the cylindrical portion of the sub-tank. The first supporting portion inwardly protrudes from the cylindrical portion in a substantially radial direction of the cylindrical portion. The guide portion has a substantially cylindrical shape. The guide portion further surrounds the outer peripheral side of the biasing means.

The fuel feed apparatus further includes a second supporting portion that is provided to the cylindrical portion of the sub-tank. The second supporting portion slidably supports the second supporting member such that the second supporting member is capable of reciprocating through the second supporting portion in the substantially axial direction of the sub-tank. The second supporting portion defines a guide plane and a groove portion. The guide plane is capable of sliding with respect to the second supporting member in the inner peripheral side of the guide plane. The groove portion divides the guide plane into at least two planes in the circumferential direction of the guide plane.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
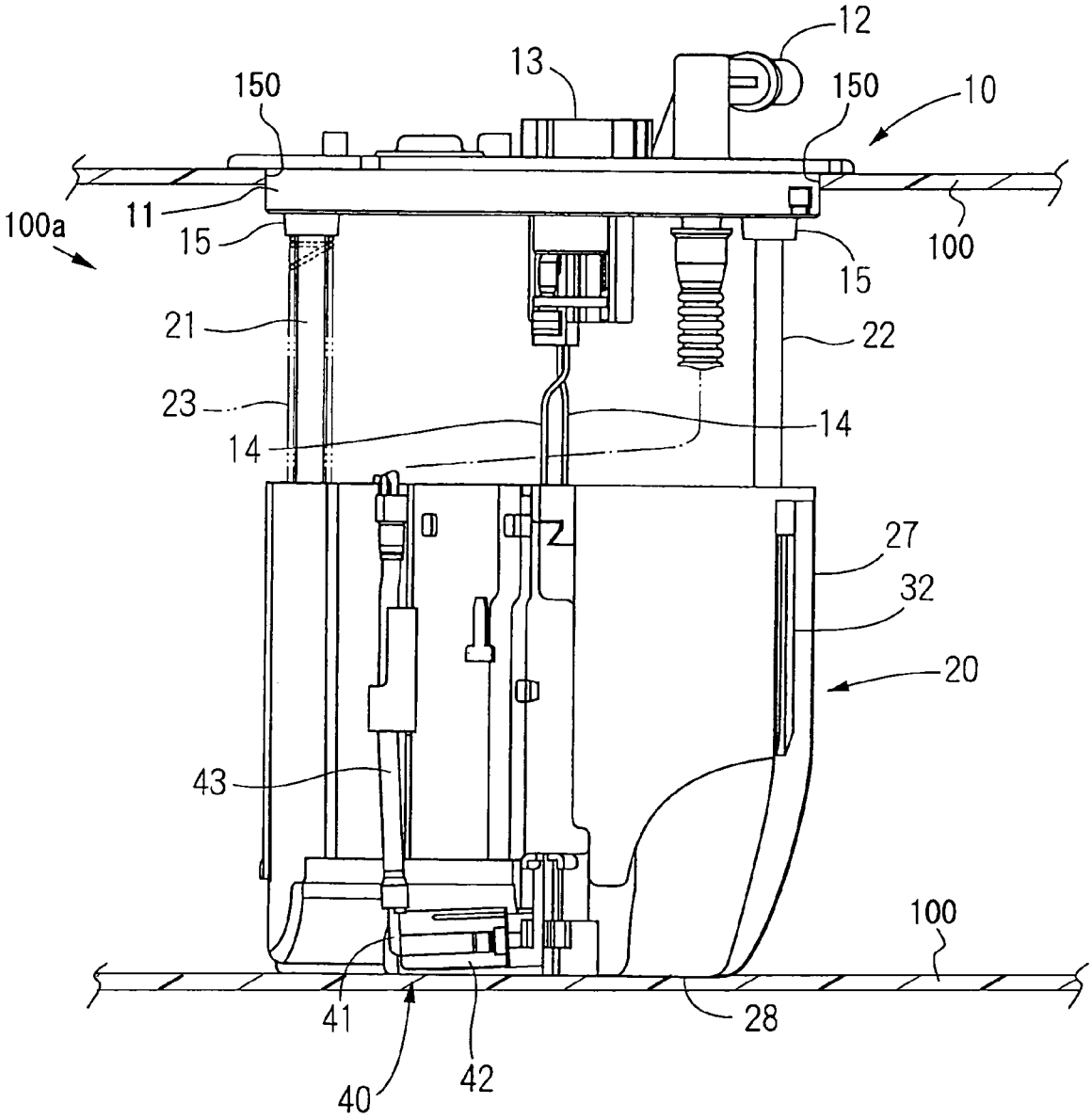
FIG. 1 is a side view showing a fuel feed apparatus according to a first embodiment of the present invention.
Figure 2:
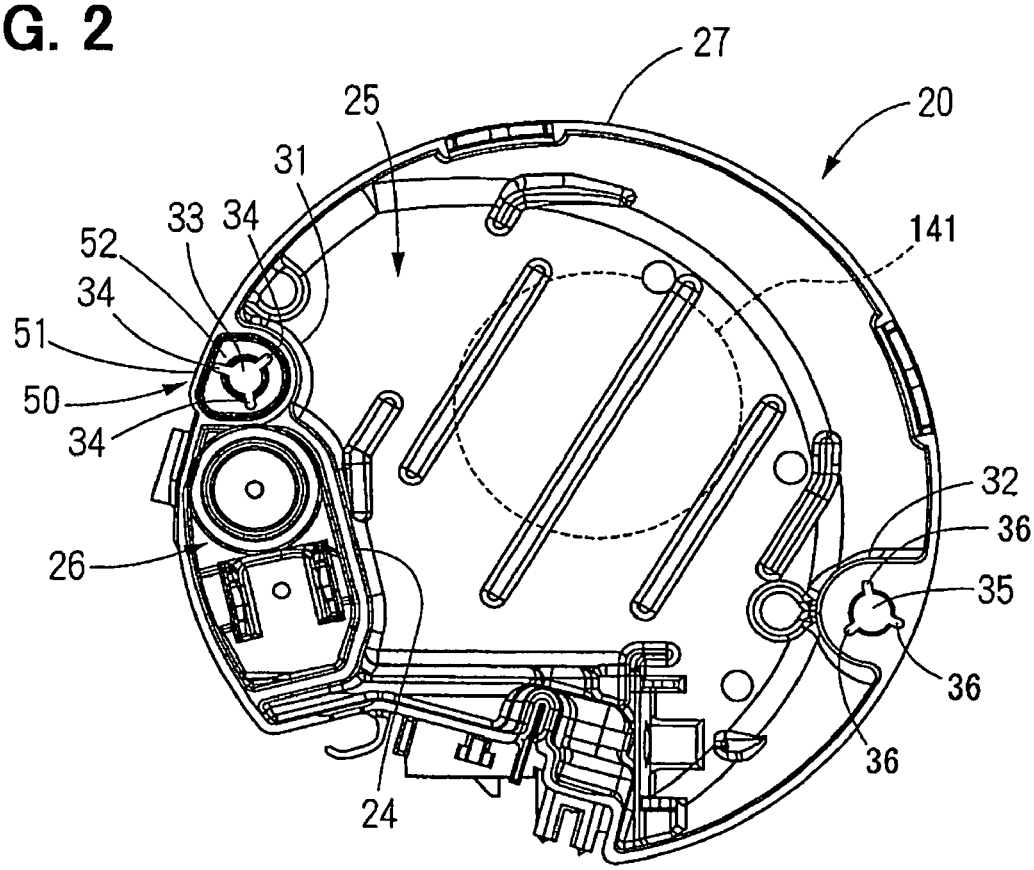
FIG. 2 is a top view showing the fuel feed apparatus according to the first embodiment.

As shown in FIG. 1, a fuel feed apparatus 10 has a circular-shaped lid member 11 that covers an opening 150 formed in an upper wall portion of a fuel tank 100. As shown in FIGS. 1, 2, the fuel feed apparatus 10 includes the lid member 11 and a sub-tank 20. The fuel feed apparatus 10 further includes a first shaft (first supporting member) 21 and a second shaft (second supporting member) 22 that support the lid member 11 and the sub-tank 20 such that the lid member 11 and the sub-tank 20 are axially movable relative to each other. Most of the fuel feed apparatus 10 is received in the fuel tank 100 excluding the lid member 11.

The lid member 11 has a discharge pipe 12 and an electric connector 13. Fuel is discharged from a fuel pump 141 (FIG. 2) received in the sub-tank 20, and the fuel flows to the outside of the fuel tank 100 through the discharge pipe 12. The electric connector 13 supplies the fuel pump 141 with electric power via a lead wire 14. The first and second shafts 21, 22 (FIG. 1) are respectively press-inserted into press-insertion portions 15 provided to the lid member 11 on one axially end portions.

The first shaft 21 is supported by a first supporting portion 31 (FIG. 2), which is provided to the sub-tank 20, on the other axially end portion. The second shaft 22 is supported by a second supporting portion 32, which is provided to the sub-tank 20, on the other axially end portion. The first supporting portion 31 and the second supporting portion 32 are substantially opposed to each other in the radial direction of the sub-tank 20.

The first and second shafts 21, 22 are made of a metallic material, such as stainless steel or aluminum, or a nonmetallic material such as resin. As referred in FIG. 1, a spring (biasing means) 23 is provided to the outer circumferential periphery of the first shaft 21. The spring 23 is in contact with one of the press-insertion portions 15 of the lid member 11 on one axial end side thereof. The spring 23 is in contact with the sub-tank 20 on the other axial end side thereof. The spring 23 axially resiliently extends such that the lid member 11 and the sub-tank 20 are axially apart from each other. Thus, the sub-tank 20 is pressed onto the inner bottom face of the fuel tank 100 by resilience of the spring 23, even when the fuel tank 100 expands or contracts due to a variation in pressure caused by a variation in temperature and a variation in amount of fuel.

The sub-tank 20 receives the fuel pump 141, a fuel filter, a suction filter, a pressure regulator, a first jet pump (none shown) and a second jet pump 40 (FIG. 1). The suction filter filters relatively large debris contained in fuel that is drawn from the inside of the sub-tank 20 by the fuel pump 141. The pressure regulator controls pressure of fuel discharged from the fuel pump 141 at a predetermined pressure. The fuel filter filters relatively small debris contained in fuel discharged from the fuel pump 141. The fuel pump 141 is received in the sub-tank 20 such that the suction side of the fuel pump 141 is arranged on the lower side in FIG. 1, and the discharge side of the fuel pump 141 is arranged on the upper side in FIG. 1. The fuel pump 141 includes a motor (not shown) to generate suction force using a rotating member (not shown) that integrally rotates with the motor. As referred in FIG. 2, the inner space of the sub-tank 20 is partitioned by a partition wall 24 into a main chamber 25 and a sub-chamber 26.

Figure 7:
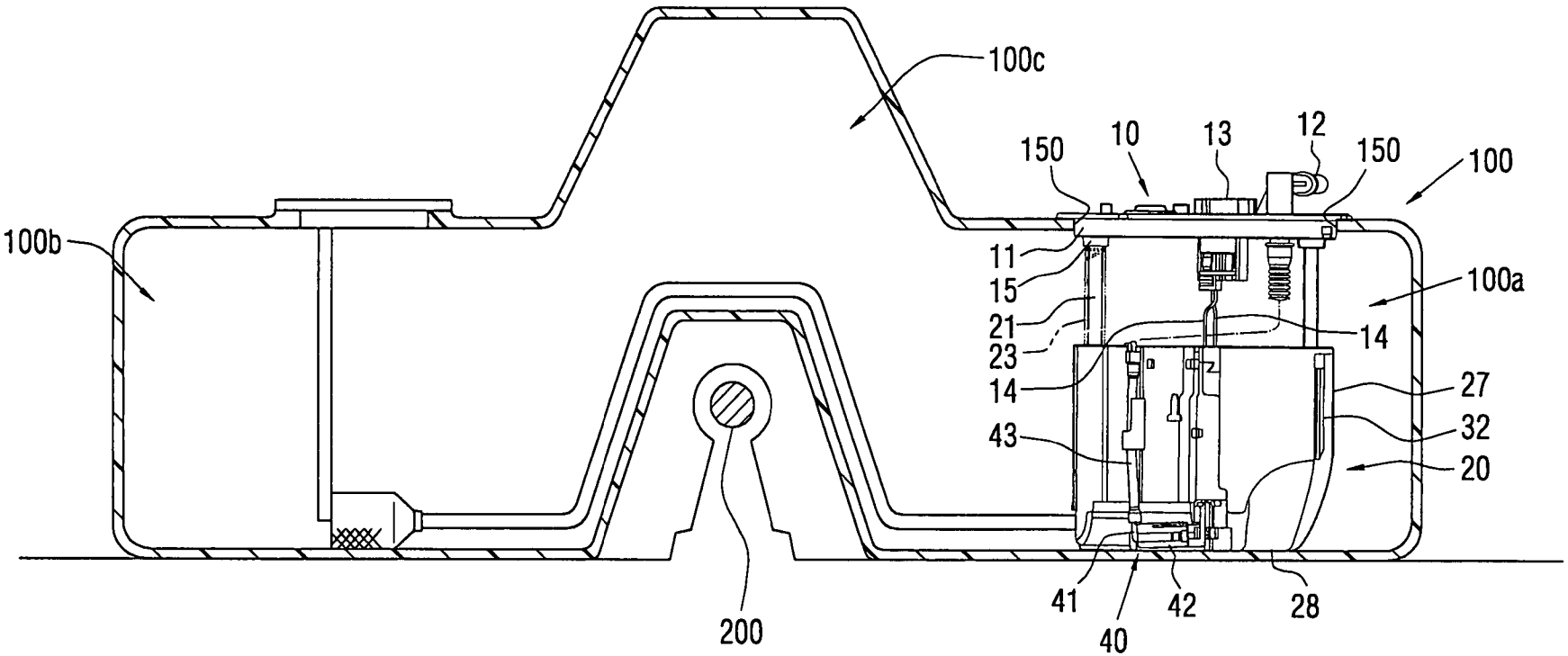
FIG. 7 is a cross-sectional side view showing a fuel tank receiving the fuel feed apparatus according to the first embodiment.
Figure 8:
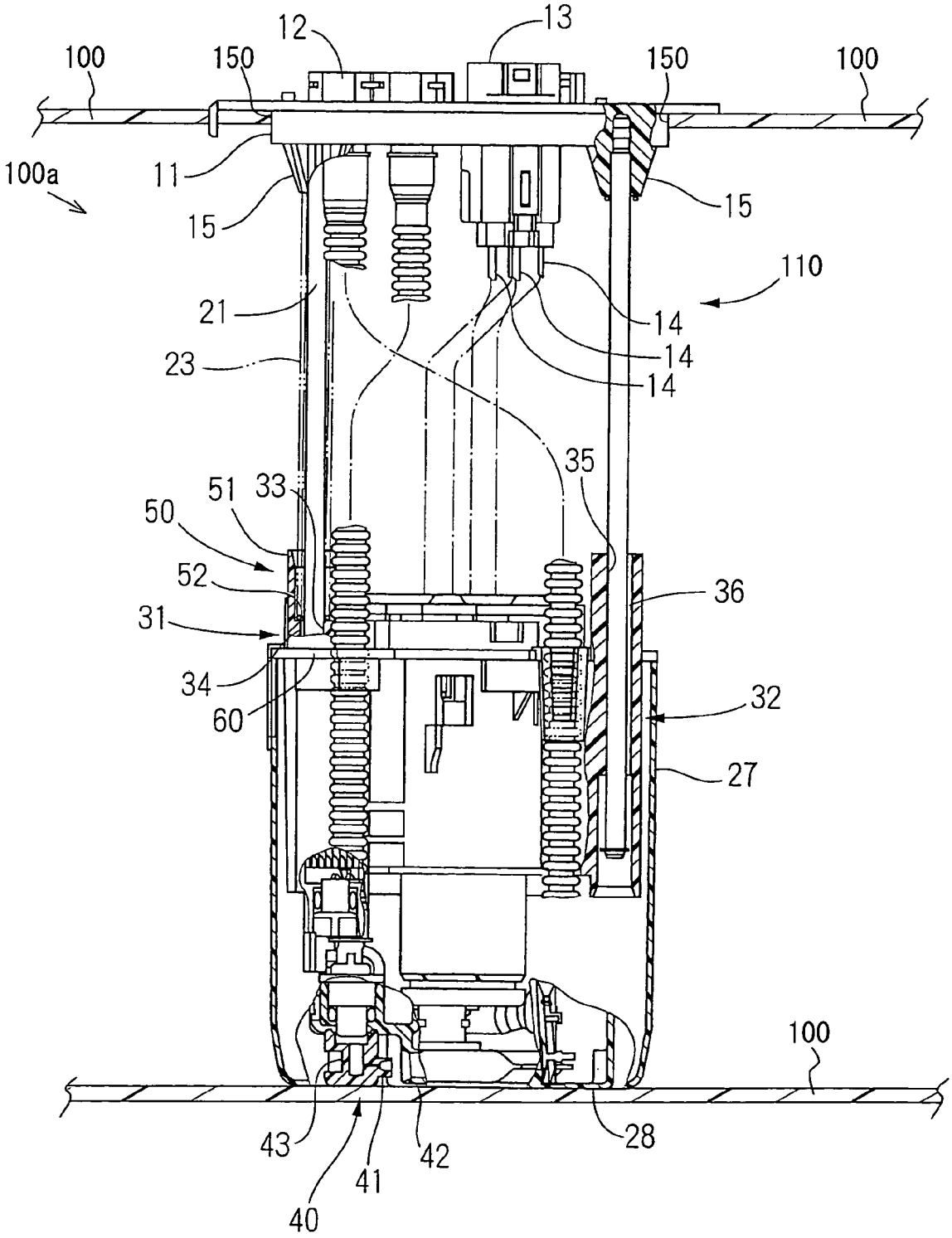
FIG. 8 is a side view showing a fuel feed apparatus according to a second embodiment of the present invention.

As shown in FIG. 7, the fuel tank 100, which receives the fuel feed apparatus 10, is integrally formed of resin to be in a saddleback shape, and is mounted in a vehicle over a drive shaft 200. The fuel tank 100 includes a first tank space 100*a* and a second tank space 100*b* that are communicated with each other through a connecting portion 100*c*, which is arranged to pass over the drive shaft 200. The fuel feed apparatus 10 is received in the first tank space 100*a* of the fuel tank 100.

As referred in FIG. 2, the sub-chamber 26 receives a first jet pump. The first jet pump supplies fuel received in the second tank space 100*b* into the sub-tank 20 that is received in the first tank space 100*a*. As referred in FIG. 1, the second jet pump 40 is provided to the outer circumferential periphery of the sub-tank 20. The second jet pump 40 includes a nozzle portion 41 and a throat portion 42. Fuel is pressurized in the fuel pump 141, and the pressurized fuel is partially supplied into the nozzle portion 41 through a fuel passage 43. Fuel is supplied from the fuel pump 141 into the nozzle portion 41, and the fuel is jetted from the nozzle portion 41 into the throat portion 42, so that suction pressure is generated in the throat portion 42, and fuel is drawn into the throat portion 42. Therefore, fuel remaining around the sub-tank 20 can be drawn into the sub-tank 20, even when liquid level of fuel decreases in the first tank space 100*a* of the fuel tank 100. As a result, the inside of the sub-tank 20 can be filled with fuel, regardless of the liquid level in the fuel tank 100.

As referred in FIGS. 1, 2, the sub-tank 20 is formed in a bottomed cylindrical shape, which is constructed of a cylindrical portion 27 and a bottom portion 28. The bottom portion 28 is arranged on the axially end portion of the cylindrical portion 27 on the axially opposite side as the lid member 11 with respect to the cylindrical portion 27. As referred in FIG. 2, the sub-tank 20 has the first supporting portion 31 and the second supporting portion 32 that are arranged on substantially end sides of the sub-tank 20 in the radial direction of the sub-tank 20. The first supporting portion 31 is adjacent to the sub-chamber 26 that receives the first jet pump. As referred in FIGS. 2, 3, the first supporting portion 31 protrudes from the cylindrical portion 27 of the sub-tank 20, which is in a substantially cylindrical shape, to the inner side substantially in the radial direction of the sub-tank 20.

Figure 3:
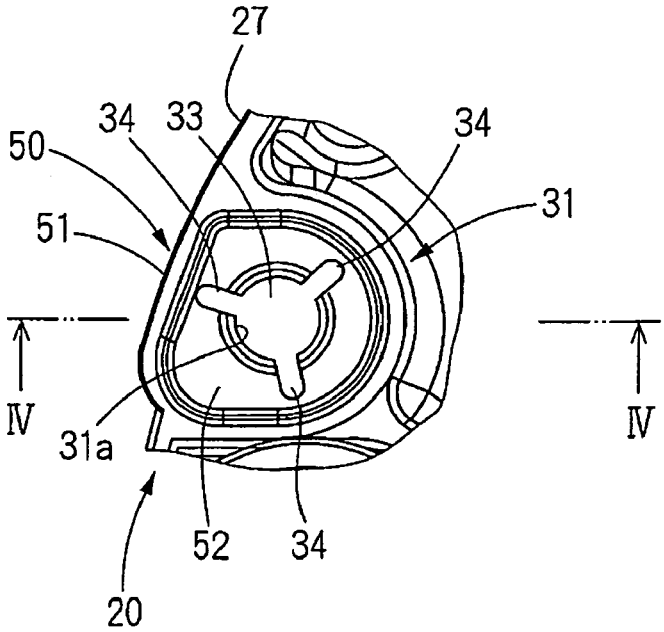
FIG. 3 is an enlarged top view showing a first supporting portion of a sub-tank of the fuel feed apparatus according to the first embodiment.
Figure 4:
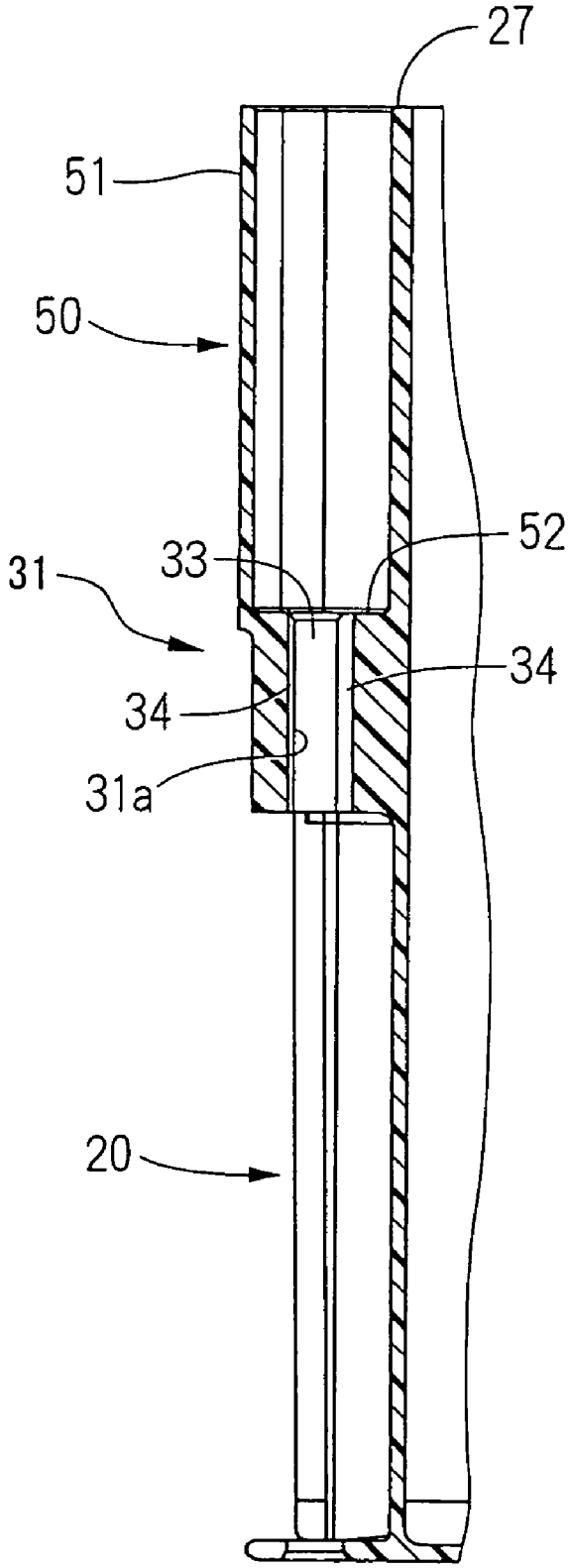
FIG. 4 is a cross-sectional side view taken along the line IV-IV in FIG. 3 according to the first embodiment.

As shown in FIG. 4, the first supporting portion 31 is arranged in the vicinity of a middle portion of the sub-tank 20 in the axial direction of the sub-tank 20. The first supporting portion 31 is formed in a substantially cylindrical shape, in which a hole portion 33, which is a through hole, is formed in a substantially center portion, i.e., radially middle portion of the first supporting portion 31. The first shaft 21 (FIG. 1) is axially movably inserted into the hole portion 33 of the first supporting portion 31. As referred in FIGS. 2, 3, multiple groove portions 34 are formed in the first supporting portion 31 such that each groove portion 34 outwardly extends from the hole portion 33 in the substantially radial direction of the first supporting portion 31. Each groove portion 34 extends in the substantially axial direction of the first supporting portion 31. The groove portions 34 are arranged in the circumferential direction of the first supporting portion 31, so that an inner wall 31*a* of the hole portion 33 of the first supporting portion 31 is divided into multiple planes such that the planes of the inner wall 31*a* are discontinuous in the circumferential direction of the first supporting portion 31.

As referred in FIGS. 2 to 4, a guide portion 50 is provided to the first supporting portion 31 on the side of the lid member 11. The guide portion 50 has a wall portion 51 that substantially circumferentially extends continuously from a substantially arc-shaped circumferential periphery of a part of the cylindrical portion 27 of the sub-tank 20. The wall portion 51 of the guide portion 50 axially extends from the first supporting portion 31 on the side of the lid member 11. The first supporting portion 31 radially internally protrudes in the substantially radial direction of the sub-tank 20. The wall portion 51 extends to the side of the lid member 11 along the outer periphery of the first supporting portion 31. Thus, the wall portion 51 cylindrically covers the first supporting portion 31 on the side of the lid member 11. The inner diameter of the guide portion 50 of the wall portion 51 and the inner diameter of the first supporting portion 31 are different from each other, so that the guide portion 50 and the first supporting portion 31 form a step 52 therebetween. The axially end portion of the first shaft 21 and the axially end portion of the spring 23, which are on the opposite side as the lid member 11, are received in a space defined by the inner periphery of the guide portion 50, which is in a substantially cylindrical shape. The end portion of the spring 23, which is on the opposite side as the end portion press-inserted into the lid member 11, makes contact with the step 52 formed between the guide portion 50 and the first supporting portion 31.

Figure 5:
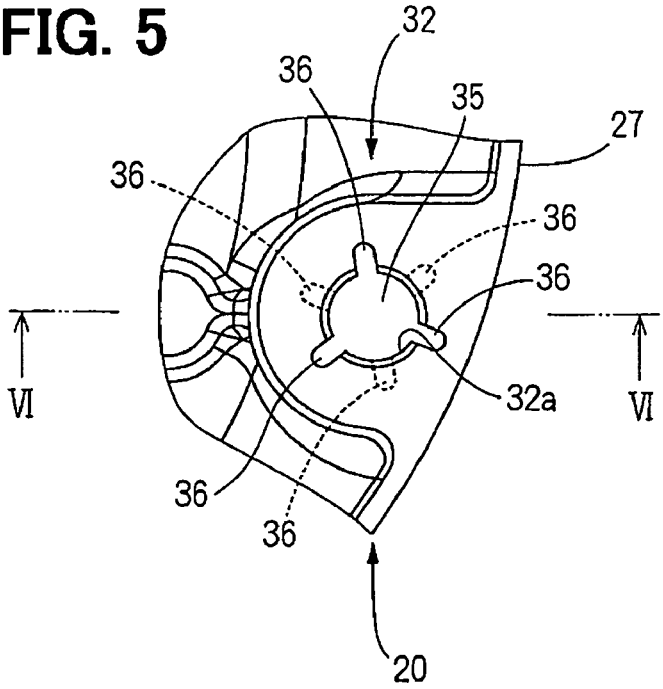
FIG. 5 is an enlarged top view showing a second supporting portion of the sub-tank according to the first embodiment.
Figure 6:
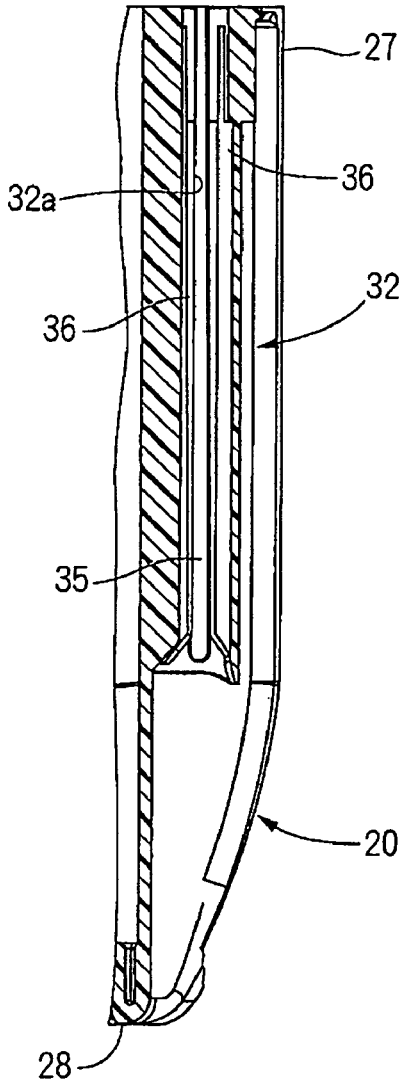
FIG. 6 is a cross-sectional side view taken along the line VI-VI in FIG. 5 according to the first embodiment.

As referred in FIG. 2, the second supporting portion 32 is arranged on the substantially opposite side as the first supporting portion 31 in the sub-tank 20 in the radial direction of the sub-tank 20. As shown in FIGS. 2, 5, the second supporting portion 32 radially internally protrudes from the cylindrical portion 27 of the sub-tank 20 in the substantially radial direction of the sub-tank 20, as well as the first supporting portion 31. As shown in FIGS. 4, 6, the position of the second supporting portion 32 is different from the position of the first supporting portion 31 in the axial direction of the sub-tank 20. Besides, the second supporting portion 32 extends in the axial direction of the second shaft 22 from the end portion of the sub-tank 20 on the side of the lid member 11, i.e., upper side in FIG. 6 to the vicinity of the bottom portion 28, i.e., lower side in FIG. 6 in contrast to the first supporting portion 31. That is, the axial length of the second supporting portion 32 is different from that of the first supporting portion 31, and the axial position of the second supporting portion 32 is different from that of the first supporting portion 31. The second supporting portion 32 is formed to be in a substantially cylindrical shape such that a hole portion 35, which is a through hole, is formed in a substantially radially center portion of the second supporting portion 32. The hole portion 35 extends in a substantially axial direction of the second supporting portion 32. The second shaft 22 (FIG. 1) is axially movably inserted into the hole portion 35 of the second supporting portion 32.

As referred in FIG. 6, the inner periphery of the second supporting portion 32 has a guide plane 32*a* that slides over the outer periphery of the second shaft 22. As referred in FIGS. 5, 6, multiple groove portions 36 are formed in the inner periphery of the second supporting portion 32 such that each groove portion 36 outwardly extends from the hole portion 35 in the substantially radial direction of the second supporting portion 32. Each groove portion 36 extends in a substantially axial direction of the second supporting portion 32. The groove portions 36 are arranged in the circumferential direction of the second supporting portion 32, so that the guide plane 32*a* of the second supporting portion 32 is divided by the groove portions 36 into multiple planes such that the planes of the guide planes 32*a* are discontinuous in the circumferential direction of the second supporting portion 32. The second supporting portion 32 extends in a substantially axial direction of the sub-tank 20. Therefore, the guide planes 32*a*, which slide over the second shaft 22, and the groove portions 36 respectively extend from the side of the lid member 11 to the side of the bottom portion 28 in the sub-tank 20.

The substantially cylindrical guide portion 50 is provided to the first supporting portion 31 on the side of the lid member 11 thereof, so that the spring 23, which is provided to the radially outer peripheral side of the first shaft 21, is received in the guide portion 50. When the lid member 11 is assembled to the sub-tank 20, the first and second shafts 21, 22 are respectively press-inserted into the press-insertion portions 15 of the lid member 11. Subsequently, the spring 23 is attached to the outer periphery of the first shaft 21 such that the first shaft 21 is inserted into the inner periphery the spring 23. The first shaft 21 is inserted into the first supporting portion 31 of the sub-tank 20, and the second shaft 22 is inserted into the second supporting portion 32, after the spring 23 is attached to the first shaft 21. In this situation, the spring 23 is received inside the guide portion 50, so that the spring 23 is positioned within the guide portion 50, and is restricted in the radial direction of the spring 23. Besides, the spring 23 is positioned by the step 52, which is formed between the guide portion 50 and the first supporting portion 31, in the axial direction of the spring 23. The spring 23 is guided by the guide portion 50 in the radial direction of the spring 23, so that the spring 23 is properly aligned in the guide portion 50. Besides, the first shaft 21 is guided by the spring 23 received in the guide portion 50 such that the first shaft 21 is smoothly inserted into the first supporting portion 31 of the sub-tank 20. As a result, the lid member 11, the sub-tank 20, the first and second shafts 21, 22 can be easily assembled to each other, even when resilient force of the spring 23 is applied to the lid member 11 and the sub-tank 20.

The second supporting portion 32 extends in a substantially axial direction thereof, and the guide plane 32*a* also extends in a substantially axial direction of the second supporting portion 32 for guiding movement of the second shaft 22 that slides over the guide plane 32*a*. Therefore, inclination of the second shaft 22 with respect to the second supporting portion 32 can be reduced. Besides, the guide plane 32*a* is divided by the groove portions 36 in the circumferential direction of the second supporting portion 32. Thus, the area of a connecting plane between the guide plane 32*a* and the second shaft 22 decreases, even the axial length of the second supporting portion 32, i.e., the guide plane 32*a* extends. Therefore, frictional resistance arising between the second shaft 22 and the second supporting portion 32 decreases, so that the second shaft 22 is capable of smoothly sliding over the inner periphery of the second supporting portion 32. Furthermore, the axial length of the first supporting portion 31 is different from the axial length of the second supporting portion 32. Besides, the axial position of the first supporting portion 31 is different from the axial position of the second supporting portion 32 with respect to the axial direction of the sub-tank 20. That is, the supporting point, i.e., pivot or fulcrum of the first shaft 21 with respect to the first supporting portion 31 is different from the supporting point of the second shaft 22 with respect to the second supporting portion 32. As a result, the second shaft 22 is not apt to be inclined in the second supporting portion 32, and the second shaft 22 can be smoothly guided by the second supporting portion 32, even when the spring 23 is provided to the first shaft 21. Therefore, the lid member 11 is capable of smoothly moving relative to the sub-tank 20, even when the inner volume of the fuel tank 100 is changed. Besides, the vertical position, i.e., axial position of the top end portion of the first supporting portion 31 is different from that of the second supporting portion 32. When the lid member 11, which is assembled to the first and second shafts 21, 22, is attached to the sub-tank 20, the second shaft 22 is inserted into the second supporting portion 32, while the spring 23 is received in the guide portion 50, and subsequently, the first shaft 21 is inserted into the inner wall 31*a* of the first supporting portion 31. When the first shaft 21 is inserted into the inner wall 31*a* of the first supporting portion 31, the second shaft 22 is already inserted into the second supporting portion 32, and the second shaft 22 is radially positioned by the second supporting portion 32. Therefore, the first shaft 21 is already positioned roughly around the inner wall 31*a* of the first supporting portion 31. Thus, the first shaft 21 can be easily aligned with respect to the inner wall 31*a* of the second supporting portion 32, and can be easily inserted into the inner wall 31*a*, even while resilient force of the spring 23 is applied to the lid member 11.

The first supporting portion 31 has the groove portions 34, and the second supporting portion 32 has the groove portions 36. Therefore, frictional resistance arising between the first shaft 21 and the first supporting portion 31 decreases, and frictional resistance arising between the second shaft 22 and the second supporting portion 32 also decreases. Foreign material may intrude into both the sliding portion between the first supporting portion 31 and the first shaft 21, and the sliding portion between the second supporting portion 32 and the second shaft 22. Even in this situation, the foreign material can be removed and exhausted from the sliding portions, which are formed between the first and second supporting portions 31, 32 and the first and second shafts 21, 22, through the groove portions 34, 36. Therefore, the sliding portions can be protected from increasing of frictional resistance therebetween due to foreign material intruding into the sliding portions, so that the lid member 11 and the sub-tank 20 can be maintained to be capable of smoothly moving axially relative to each other.

Other Embodiment

The above structure is not limited to be applied to the above fuel feed apparatus 10. The above structure may be applied to a fuel feed apparatus 110 shown in FIG. 7. In the fuel feed apparatus 110, the sub-tank 20 has a cover 60 on the side of the lid member 11 such that the cover 60 covers the end portion, i.e., opening end portion of the sub-tank 20 that is located on the opposite side as the bottom portion of the sub-tank 20. The cover 60 has the first and second supporting portions 31, 32 such that the first and second supporting portions 31, 32 respectively protrude from the cover 60 to the side of the lid member 11. Here, the first and second supporting portions 31, 32 respectively have structures that are equivalent to the structures described in the above embodiment.

The above structure may be applied to a fuel feed apparatus that has a structure different from that of the above fuel feed apparatuses 10, 110. The above structure is not limited to be applied to the fuel tank in a saddleback shape, and the shape of the fuel tank may be changed as appropriate. Besides, components received in the sub-tank may be changed as appropriate.

Various modifications and alternations may be diversely made to the above embodiments without departing from the spirit of the present invention.

What is claimed is:

1. A fuel feed apparatus that is at least partially received in a fuel tank, the fuel feed apparatus comprising:

a lid member that covers an opening portion defined in the fuel tank;

a sub-tank that is received in the fuel tank, the sub-tank including a cylindrical portion and a bottom portion, the bottom portion located on an opposite side of the lid member with respect to the cylindrical portion, the sub-tank receiving a fuel pump;

a first supporting member that is arranged in a substantially end portion of the cylindrical portion in a radial direction of the cylindrical portion;

a second supporting member that is arranged in a substantially end portion of the cylindrical portion in the radial direction of the cylindrical portion, the second supporting member arranged on a substantially opposite side as the first supporting member in the radial direction of the cylindrical portion, wherein the first supporting member and the second supporting member support the lid member and the sub-tank so that the lid member is capable of moving relative to the sub-tank in the substantially axial direction of the sub-tank;

a biasing means that is arranged on an outer peripheral side of the first supporting member, the biasing means biasing the lid member and the sub-tank to be apart from each other;

a first supporting portion that is provided to the cylindrical portion of the sub-tank, the first supporting portion slidably supporting the first supporting member so that the first supporting member is capable of reciprocating through the first supporting portion in the substantially axial direction of the sub-tank; and a guide portion that is arranged on a side of the lid member with respect to the first supporting portion, the guide portion at least partially surrounding the outer peripheral side of the first supporting member, wherein the first supporting portion has an inner wall defining at least one groove portion therein, the at least one groove portion extends radially outwardly from the inner wall of the first supporting portion to a radial end thereof, and the radial end of the at least one groove portion is radially spaced from a wall surface of the guide portion and a wall surface of the cylindrical portion to define a step on which the biasing means is seated and so that the axial end of the biasing means is restricted from causina interference with the at least one groove portion, wherein the guide portion has a substantially cylindrical shape, and the guide portion further surrounds the outer peripheral side of the biasing means, further comprising:

a second supporting portion that is provided to the cylindrical portion of the sub-tank the second supporting portion slidably supporting the second supporting member so that the second supporting member is capable of reciprocating through the second supporting portion in the substantially axial direction of the sub-tank, wherein the second supporting portion defines:

a guide plane that is capable of sliding with respect to the second supporting member in an inner peripheral side of the guide plane, wherein the second supporting portion extends from an end portion of the sub-tank on a side of the lid member to a vicinity of an end portion of the sub-tank on a side of the bottom portion.

2. The fuel feed apparatus according to claim 1, wherein the first supporting portion is integrally formed with the cylindrical portion of the sub-tank, and the first supporting portion inwardly protrudes from the cylindrical portion in a substantially radial direction of the cylindrical portion.

3. The fuel feed apparatus according to claim 1, wherein the second supporting portion defines:

a groove portion that divides the guide plane into at least two planes in a circumferential direction of the guide plane.

4. The fuel feed apparatus according to claim 1, wherein the inner wall is capable of sliding with respect to the first supporting member in an inner peripheral side of the inner wall; and the at least one groove portion divides the inner wall Into at least two planes in a circumferential direction of the inner wall.

5. The fuel feed apparatus according to claim 1, wherein the second supporting portion is integrally formed with the cylindrical portion of the sub-tank, and the second supporting portion inwardly protrudes from the cylindrical portion in a substantially radial direction of the cylindrical portion.

6. The fuel feed apparatus according to claim 3, wherein the first supporting portion is arranged at a position in an axial direction of the sub-tank, the position of the first supporting portion in the axial direction of the sub-tank is different from a position of the second supporting portion in the axial direction of the sub-tank, the first supporting portion has a length in the axial direction of the sub-tank, and the length of the first supporting portion in the axial direction of the sub-tank is different from a length of the second supporting portion in the axial direction of the sub-tank.

7. The fuel feed apparatus according to claim 1, wherein the second supporting portion has a lower end portion that is located at a position in the axial direction of the sub-tank on the side of the bottom portion of the sub-tank, the first supporting portion has an lower end portion that is located at a position in the axial direction of the sub-tank on the side of the bottom portion of the sub-tank, and the position of the lower end portion of the second supporting portion is located on the side of the bottom portion of the sub-tank with respect to the position of the lower end portion of the first supporting portion in the axial direction of the sub-tank.

* * * * *